US009366208B2

(12) United States Patent
Meyer

(10) Patent No.: US 9,366,208 B2
(45) Date of Patent: Jun. 14, 2016

(54) ELECTRONICALLY CONTROLLED FUEL INJECTOR WITH FUEL FLOW RATE SUBSTANTIALLY INDEPENDENT OF FUEL INLET PRESSURE

(71) Applicant: Andrew E Meyer, Harpers Ferry, WV (US)

(72) Inventor: Andrew E Meyer, Harpers Ferry, WV (US)

( * ) Notice: Subject to any disclaimer, the term of this patent is extended or adjusted under 35 U.S.C. 154(b) by 0 days.

(21) Appl. No.: 14/616,524

(22) Filed: Feb. 6, 2015

(65) Prior Publication Data

US 2015/0152821 A1 Jun. 4, 2015

Related U.S. Application Data

(63) Continuation of application No. 13/106,789, filed on May 12, 2011, now Pat. No. 8,950,694, which is a continuation of application No. 12/409,903, filed on Mar. 24, 2009, now Pat. No. 7,942,349.

(51) Int. Cl.

| | |
|---|---|
| ***B05B 1/30*** | (2006.01) |
| ***F02M 51/06*** | (2006.01) |
| ***F02M 61/08*** | (2006.01) |

(Continued)

(52) U.S. Cl.

CPC ..... *F02M 51/061* (2013.01); *F02M 61/08* (2013.01); *F02M 61/12* (2013.01); *F02M 61/18* (2013.01); *F02M 61/1886* (2013.01); *F02M 61/205* (2013.01); *F02M 69/145* (2013.01); *F02M 51/0653* (2013.01); *F02M 2200/28* (2013.01)

(58) Field of Classification Search

CPC ... F02M 55/008; F02M 55/04; F02M 51/061; F02M 69/50

USPC ..... 239/533.12, 533.9, 585.1, 585.4, 585.5

See application file for complete search history.

(56) References Cited

U.S. PATENT DOCUMENTS

| | | | |
|---|---|---|---|
| 3,069,099 | A | 12/1962 | Graham |
| 3,923,248 | A | 12/1975 | Cressell |

(Continued)

FOREIGN PATENT DOCUMENTS

| | | |
|---|---|---|
| DE | 102004044820 | 3/2006 |
| EP | 1111230 | 6/2001 |

(Continued)

OTHER PUBLICATIONS

International Search Report and Written Opinion of the International Searching Authority; PCT application No. US2011/036551; Feb. 17, 2012.

*Primary Examiner* — Davis Hwu

(74) *Attorney, Agent, or Firm* — Louis J. Hoffman; David S. Alavi

(57) ABSTRACT

A fuel injector body has a fuel chamber and a valve seat around a fuel outlet. A valve body is positioned at the valve seat and a valve stem extends through the fuel outlet and fuel chamber. Engagement (disengagement) of valve body and valve seat closes (opens) the injector. The fuel chamber can comprise primary and secondary chambers connected by a valve passage and a metering member that restricts fuel flow between the chambers, thereby providing a flow-dependent closing force that reduces the dependence of fuel flow through the injector on fuel inlet pressure and that makes that flow dependent on an injector actuating force. The injector body or the valve body can comprise a spray-shaping surface arranged at least partly around the valve seat, which spray-shaping surface is arranged to direct a spray of fuel flowing through the fuel outlet.

7 Claims, 7 Drawing Sheets

(51) Int. Cl.

| | |
|---|---|
| ***F02M 61/12*** | (2006.01) |
| ***F02M 61/18*** | (2006.01) |
| ***F02M 61/20*** | (2006.01) |
| ***F02M 69/14*** | (2006.01) |

(56) References Cited

U.S. PATENT DOCUMENTS

| | | | | |
|---|---|---|---|---|
| 4,270,257 | A | 6/1981 | Kimata | |
| 4,550,875 | A | 11/1985 | Teerman et al. | |
| 4,572,433 | A | 2/1986 | Deckard | |
| 4,693,424 | A | 9/1987 | Sczomak | |
| 4,750,675 | A | 6/1988 | Sczomak | |
| 4,813,610 | A | 3/1989 | Renowden | |
| 4,852,853 | A | 8/1989 | Toshio et al. | |
| 4,932,591 | A | 6/1990 | Cruz | |
| 4,982,708 | A | 1/1991 | Stutzenberger | |
| 5,020,500 | A | 6/1991 | Kelly | |
| 5,088,467 | A | 2/1992 | Mesenich | |
| 5,191,867 | A | 3/1993 | Glassey | |
| 5,513,798 | A | 5/1996 | Tavor | |
| 5,544,816 | A * | 8/1996 | Nally | F02M 51/005 239/585.5 |
| 5,551,638 | A | 9/1996 | Caley | |
| 5,577,473 | A | 11/1996 | Linder | |
| 5,833,142 | A | 11/1998 | Caley | |
| 5,979,803 | A | 11/1999 | Peters et al. | |
| 6,012,701 | A * | 1/2000 | Reiter | F02M 51/0625 239/585.4 |
| 6,055,948 | A | 5/2000 | Shiraishi et al. | |
| 6,247,450 | B1 | 6/2001 | Jiang | |
| 6,405,947 | B2 * | 6/2002 | Fochtman | F02M 51/0671 239/585.4 |
| 6,435,429 | B1 | 8/2002 | Eichendorf et al. | |
| 6,439,483 | B2 | 8/2002 | Meyer | |
| 6,446,597 | B1 | 9/2002 | McAlister | |
| 6,568,080 | B2 | 5/2003 | Kimmel et al. | |
| 6,708,905 | B2 | 3/2004 | Borissov et al. | |
| 6,725,838 | B2 | 4/2004 | Shafer et al. | |
| 6,746,028 | B2 | 6/2004 | Barbee | |
| 6,755,175 | B1 | 6/2004 | McKay et al. | |
| 6,923,387 | B2 | 8/2005 | Carlisle et al. | |
| 6,978,942 | B2 | 12/2005 | Murdoch | |
| 7,083,126 | B2 | 8/2006 | Lehtonen et al. | |
| 7,137,571 | B2 | 11/2006 | Caley et al. | |
| 7,188,788 | B2 | 3/2007 | Augustin | |
| 7,350,539 | B2 | 4/2008 | Kaneko | |
| 7,353,806 | B2 | 4/2008 | Gant | |
| 7,581,686 | B2 | 9/2009 | Holzgrefe et al. | |
| 2004/0124274 | A1 | 7/2004 | Yildirim et al. | |
| 2005/0151103 | A1 | 7/2005 | Kubota et al. | |
| 2008/0210199 | A1 | 9/2008 | Zeng et al. | |
| 2008/0245902 | A1 | 10/2008 | Hou | |
| 2009/0032622 | A1 | 2/2009 | Gibson et al. | |
| 2011/0215176 | A1 | 9/2011 | Meyer | |

FOREIGN PATENT DOCUMENTS

| | | |
|---|---|---|
| EP | 1335129 | 8/2003 |
| WO | WO 2008052840 | 5/2008 |
| WO | WO 2011022821 | 3/2011 |

* cited by examiner

ELECTRONICALLY CONTROLLED FUEL INJECTOR WITH FUEL FLOW RATE SUBSTANTIALLY INDEPENDENT OF FUEL INLET PRESSURE

CROSS-REFERENCE TO RELATED APPLICATIONS

This application is a continuation of application Ser. No. 13/106,789, filed May 12, 2011, now U.S. Pat. No. 8,950,694, which is a continuation of application Ser. No. 12/409,903, filed Mar. 24, 2009, now U.S. Pat. No. 7,942,349.

BACKGROUND

The field of the present invention relates to fuel injectors. In particular, fuel injectors are disclosed herein that can maintain a fuel flow rate that is substantially independent of fuel source pressure, or that can deliver fuel in a desired spray pattern.

A wide variety of fuel injectors have been disclosed previously. Some of those are described in:

U.S. Pat. No. 4,550,875 entitled "Electromagnetic unit fuel injector with piston assist solenoid actuated control valve" issued Nov. 5, 1985 to Teerman et al;

U.S. Pat. No. 4,572,433 entitled "Electromagnetic unit fuel injector" issued Feb. 25, 1986 to Deckard;

U.S. Pat. No. 4,693,424 entitled "Poppet covered orifice fuel injection nozzle" issued Sep. 15, 1987 to Sczomak;

U.S. Pat. No. 4,750,675 entitled "Damped opening poppet covered orifice fuel injection nozzle" issued Jun. 14, 1988 to Sczomak;

U.S. Pat. No. 4,813,610 entitled "Gasoline injector for an internal combustion engine" issued Mar. 21, 1989 to Renowden;

U.S. Pat. No. 4,852,853 entitled "Pressure balance type solenoid controlled valve" issued Aug. 1, 1989 to Toshio et al;

U.S. Pat. No. 5,088,467 entitled "Electromagnetic injection valve" issued Feb. 18, 1992 to Mesenich;

U.S. Pat. No. 5,191,867 entitled "Hydraulically-actuated electronically-controlled unit injector fuel system having variable control of actuating fluid pressure" issued Mar. 9, 1993 to Glassey;

U.S. Pat. No. 5,979,803 entitled "Fuel injector with pressure balanced needle valve" issued Nov. 9, 1999 to Peters et al;

U.S. Pat. No. 6,247,450 entitled "Electronic controlled diesel fuel injection system" issued Jun. 19, 2001 to Jiang;

U.S. Pat. No. 6,446,597 entitled "Fuel delivery and ignition system for operation of energy conversion systems" issued Sep. 10, 2002 to McAlister;

U.S. Pat. No. 6,435,429 entitled "Fuel injection valve" issued Aug. 20, 2002 to Eichendorf et al;

U.S. Pat. No. 6,725,838 entitled "Fuel injector having dual mode capabilities and engine using same" issued Apr. 27, 2004 to Shafer et al;

U.S. Pat. No. 7,083,126 entitled "Fuel injection arrangement" issued Aug. 1, 2006 to Lehtonen et al;

U.S. Pat. No. 7,350,539 entitled "Electromagnetic controlled fuel injection apparatus with poppet valve" issued Apr. 1, 2008 to Kaneko;

U.S. Pat. No. 7,353,806 entitled "Fuel injector with pressure balancing valve" issued Apr. 8, 2008 to Gant;

U.S. Pat. Pub. 2005/0151103 entitled "Method and apparatus for driving flow control electromagnetic proportional control valve" published Jul. 14, 2005 in the names of Kubota et al; and U.S. Pat. Pub. 2008/0210199 entitled "Fuel injector" published Sep. 4, 2008 in the names of Zeng et al.

Each of the foregoing patent documents is hereby incorporated by reference as if fully set forth herein.

It would be desirable to provide a fuel injector having reduced dependence of fuel flow rate on fuel inlet pressure. It would be desirable to provide a fuel injector which has fuel flow rate which can be varied electronically during the injection. It would be desirable to provide a fuel injector having at least one spray-shaping surface to yield a desired fuel spray shape. Each of the foregoing patent references appears to lack those features.

SUMMARY

A fuel injector comprises an injector body and a reciprocating valve. The injector body has a fuel chamber, a fuel inlet connected to the fuel chamber, a fuel outlet connected to the fuel chamber, and a valve seat around the fuel outlet. The reciprocating valve comprises a valve stem and a valve body and is positioned with the valve body at the valve seat and with the valve stem extending from the valve body through the fuel outlet and fuel chamber. The valve and injector body are arranged so that movement of the valve in a first direction causes engagement of the valve body and the valve seat and substantially prevents fuel flow through the fuel outlet, and movement of the valve in a second direction opposite the first direction causes disengagement of the valve body and the valve seat and enables fuel flow through the fuel outlet.

The fuel chamber can comprise primary and secondary fuel chambers, and the fuel injector can further comprise a primary valve seal and a metering member. The primary and secondary fuel chambers are connected by a valve passage, the fuel inlet is connected to the primary fuel chamber, and the fuel outlet is connected to the secondary fuel chamber. The primary valve seal is engaged with the primary fuel chamber and is positioned and arranged to substantially prevent fuel flow around the valve stem through the engaged portion of the primary fuel chamber. The metering member is positioned and arranged to restrict fuel flow from the primary fuel chamber into the secondary fuel chamber.

The injector body can comprise a spray-shaping surface arranged at least partly around the valve seat, or the valve body can comprise a spray-shaping surface arranged at least partly around a valve-seat-engaging portion of the valve body. The spray-shaping surface is arranged to direct a spray of fuel flowing through the fuel outlet.

Objects and advantages pertaining to fuel injectors may become apparent upon referring to the exemplary embodiments illustrated in the drawings and disclosed in the following written description or appended claims.

The embodiments shown in the figures are exemplary and should not be construed as limiting the scope of the present disclosure or appended claims.

DETAILED DESCRIPTION OF EMBODIMENTS

Figure 1:
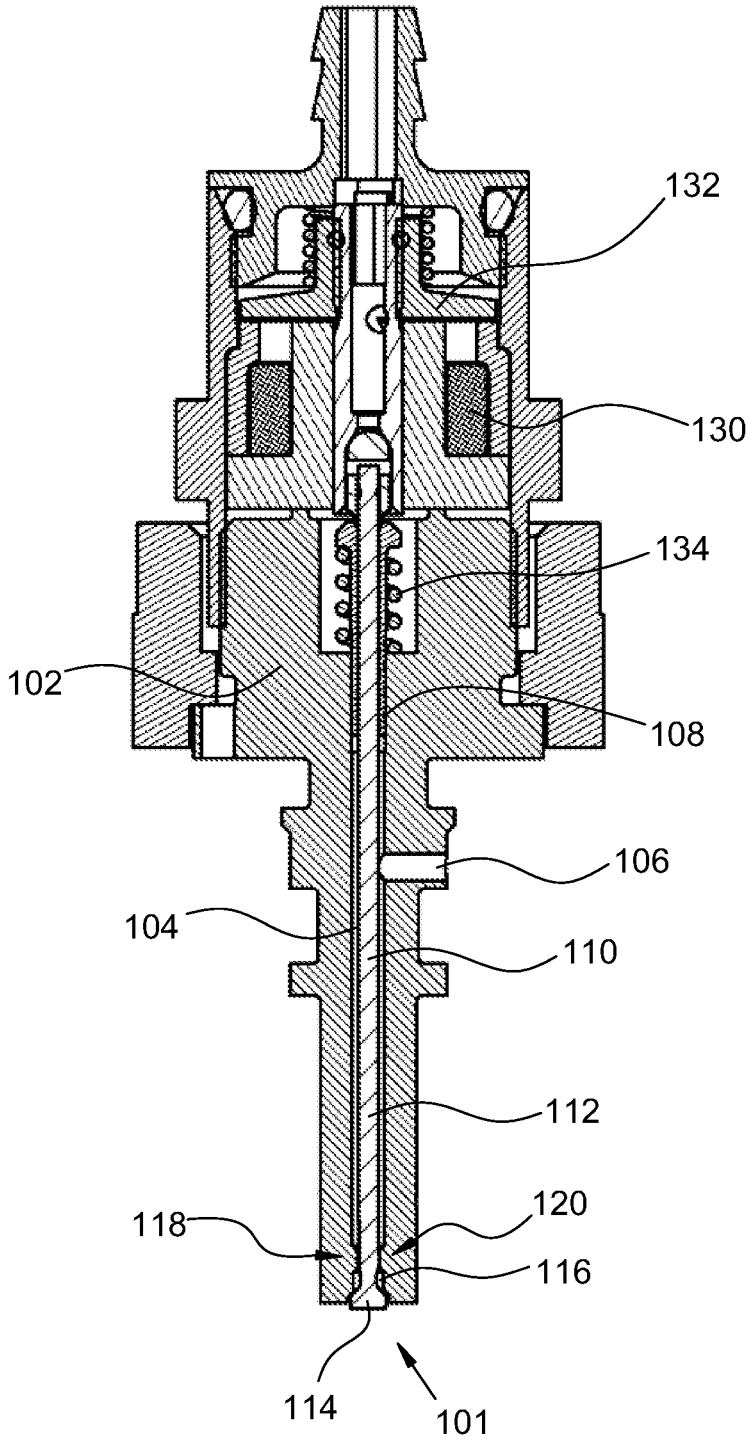
FIG. 1 is a cross-sectional view of an exemplary fuel injector.

An exemplary fuel injector 10 is shown in FIG. 1 and comprises injector body 102 and reciprocating valve 110. An axial bore through injector body 102 forms a fuel chamber (in this example a primary fuel chamber 104 and a secondary fuel chamber 116 connected by a radially constricted valve passage 118; other examples can include any suitable arrangement of one or more fuel chambers). A fuel inlet 106 is connected to primary fuel chamber 104, and fuel outlet 101 is connected to secondary fuel chamber 116. During operation of this example, fuel (or a fuel/air mixture) flows from a fuel supply (not shown) through fuel inlet 106, into primary fuel chamber 104, into secondary fuel chamber 116, and then out through fuel outlet 101. Valve seat 140 (labeled in FIGS. 3-5) is arranged around fuel outlet 101.

Valve 110 comprises valve body 114, positioned just outside fuel outlet 101, and valve stem 112, which extends through fuel outlet 101, fuel chambers 104 and 116, and valve passage 118. Axial movement of valve 110 in a first direction (up, as shown in the figures) causes valve body 114 to engage valve seat 140, thereby substantially preventing fuel flow through the fuel outlet (i.e., closing the injector). Movement of valve 110 in the other direction (down, as shown in the figures) causes disengagement of valve body 114 from valve seat 140, thereby enabling fuel flow through fuel outlet 101 (i.e., opening the injector). The fuel outlet typically is defined by the engagement of valve body 114 and valve seat 140, and the fuel injector can include additional passages, channels, or other flow-directing structures after the fuel outlet 101 (i.e., outside the secondary fuel chamber 116).

A resilient spring member of any suitable type or arrangement is typically employed to bias valve 110 in the first direction, keeping the fuel injector closed. In the exemplary fuel injector of FIG. 1, a compressed coil spring 134 is employed. When it is desired to open the fuel injector, an actuator responsive to a control signal applies an opening force to valve 110 in the second direction, overcoming the spring closing force and opening fuel injector 10. In the example of FIG. 1 the actuator comprises solenoid 130 and armature 132.

Any other suitable actuator can be employed, e.g., a piezoelectric actuator. Any other suitable arrangement can be employed for opening or closing the fuel injector. For example, the spring can be arranged to apply the force in the second (i.e., opening) direction and the actuator can be arranged to apply the force in the first (i.e., closing) direction. In another example, one or more actuators can be employed to supply forces in both directions.

In an exemplary embodiment, primary valve seal 108 engages primary fuel chamber 104 to substantially prevent fuel flow around valve stem 112 through that portion of fuel chamber 104 that engages valve seal 108. A circumferential flange 119 extending radially inward forms radially constricted valve passage 118 that engages valve stem 112 to substantially block fuel flow around valve stem 112. Valve stem 112 can also include a circumferential flange attached to and extending radially outward to engage valve passage 118. Care must be taken so that the relative areas of such an outwardly extending flange, the primary valve seal 108, and that portion of the valve body 114 subject to fuel pressure in secondary fuel chamber 116 result in suitable forces exerted on the valve 110 (see below).

Figure 3:
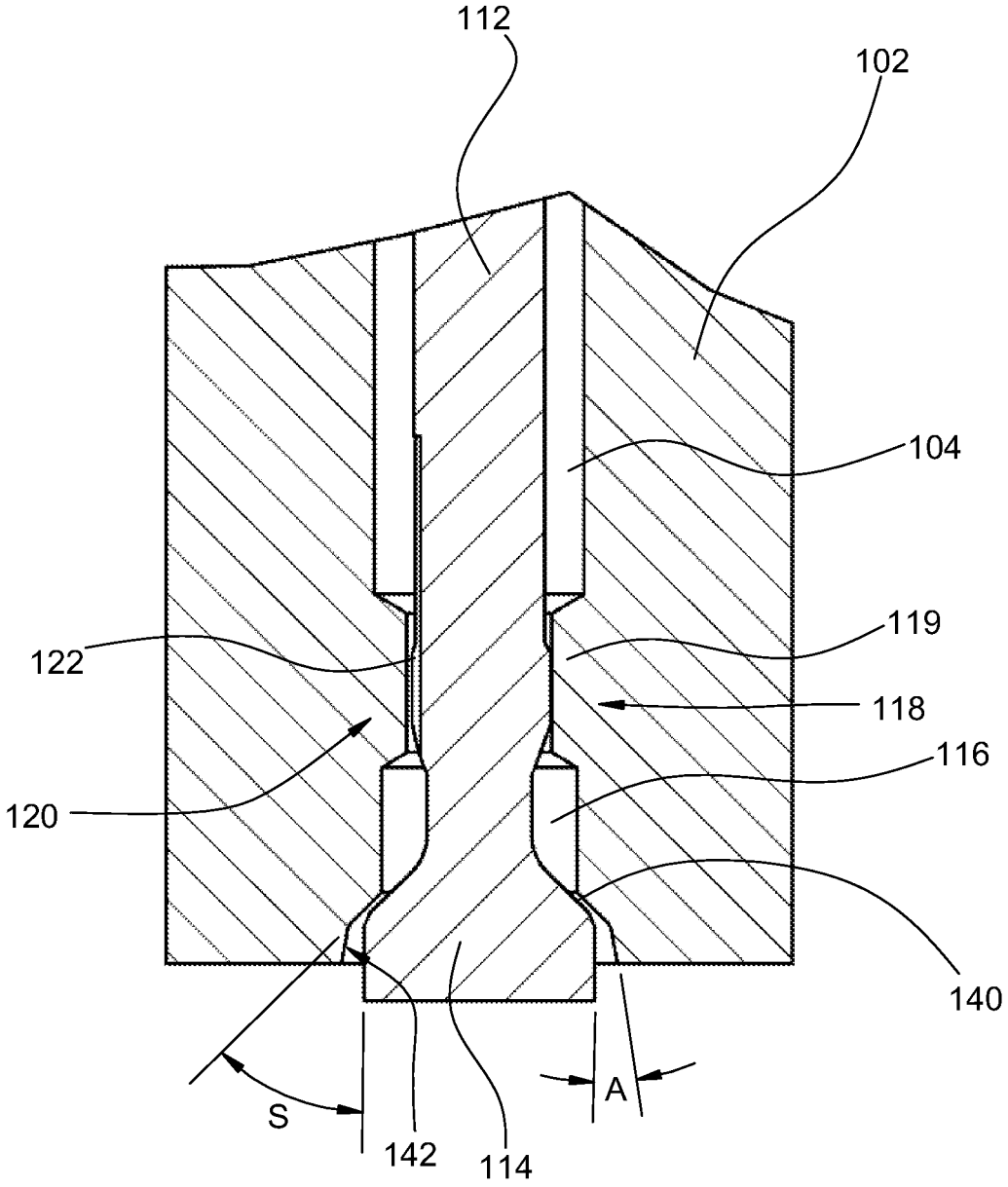
FIG. 3 is a cross-sectional view of a fuel outlet and valve body of the exemplary fuel injector of FIG. 1.
Figure 4:
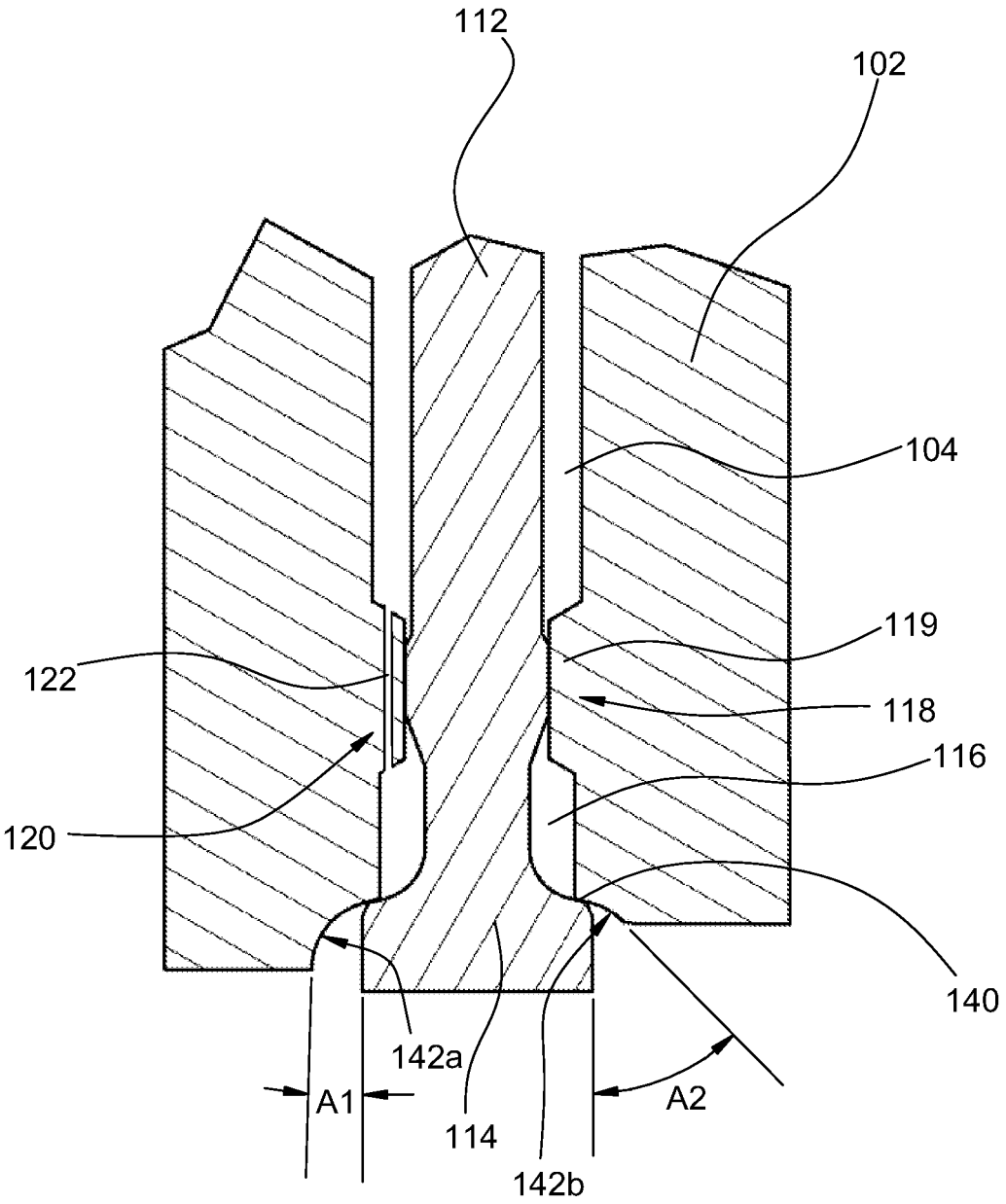
FIG. 4 is a cross-sectional view of a fuel outlet and valve body of an exemplary fuel injector.
Figure 5:
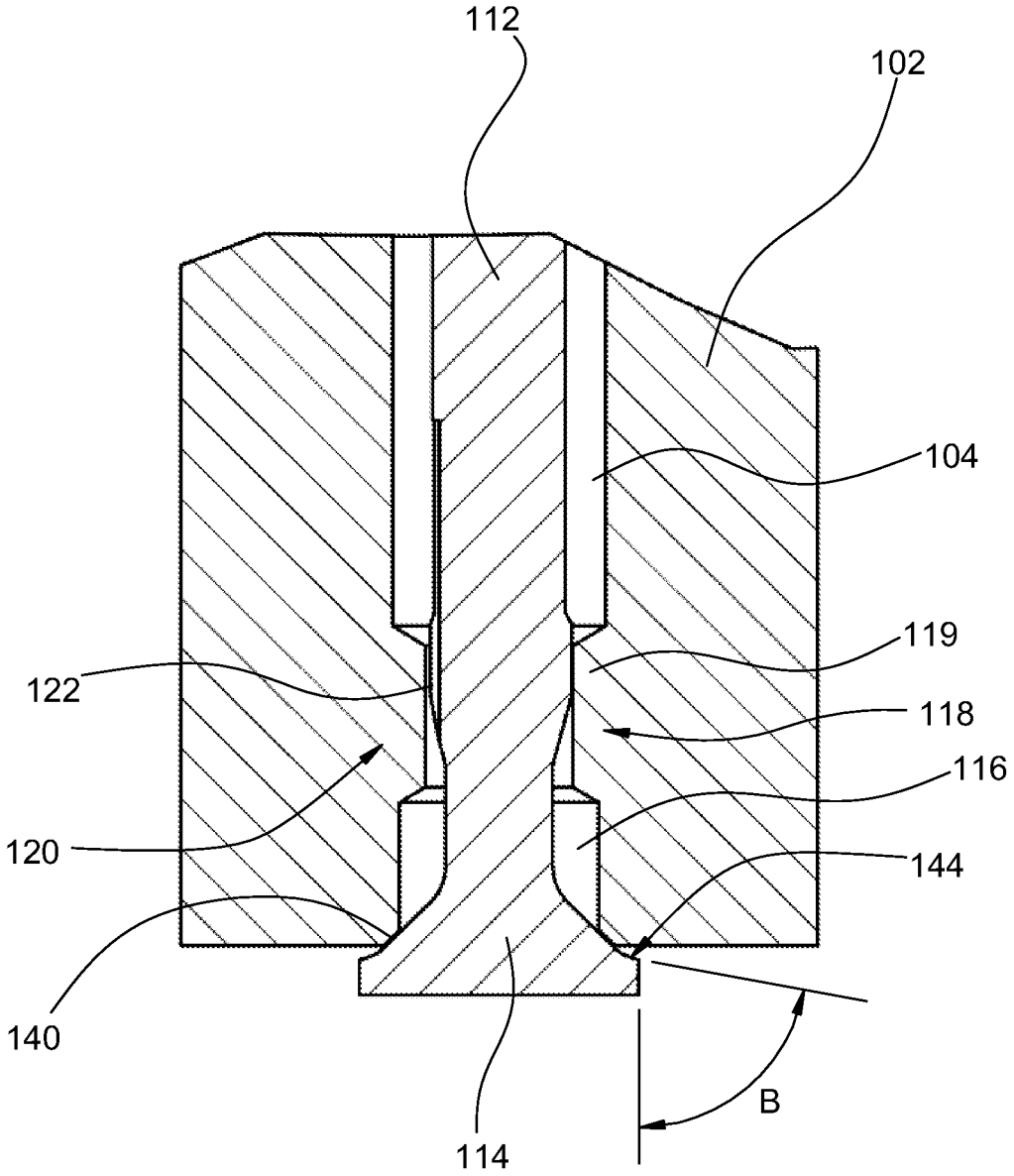
FIG. 5 is a cross-sectional view of a fuel outlet and valve body of an exemplary fuel injector.

Metering member 120 is arranged to restrict fuel flow from primary fuel chamber 104 to secondary fuel chamber 116. In the examples of FIGS. 3 and 5, metering member 120 comprises the radially constricted valve passage 118 that engages valve stem 112. Flange 119 or the engaged portion of valve stem 112 can be provided with at least one axially extending groove or flat portion that extends the length of flange 119. Flange 119 and valve stem 112 do not engage one another at such a groove or flat portion, thereby leaving a metering orifice 122 that permits restricted fuel flow between primary and secondary fuel chambers 104 and 116. In the example of FIG. 4, metering member 120 comprises a metering orifice 122 that is formed by a bore or passage through flange 119 that connects primary fuel chamber 104 and secondary fuel chamber 116. Any passage or orifice connecting primary fuel chamber 104 and secondary fuel chamber 116 can be employed that permits suitably restricted fuel flow between them. Such a passage or orifice can be formed in injector body 102, flange 119, valve stem 112, or between the flange 119 and valve stem 112 (e.g., formed by a groove or flat portion as described above).

When fuel injector 10 is closed, fuel pressure is equalized between primary fuel chamber 104 and secondary fuel chamber 116 through metering orifice 122. Fuel pressure in primary fuel chamber 104 exerts a force in the first direction on valve 110 against primary valve seal 108. Fuel pressure in secondary fuel chamber 116 exerts a force in the second direction on valve 110 against that portion of valve body 114 that lies within valve seat 140 and is not occupied by valve stem 112. If the projected areas (perpendicular to valve stem 112) where those forces are applied are substantially equal to one another, then the fuel pressure exerts no net force on valve 110. Fuel injector 10 is considered pressure-balanced when it substantially meets this condition. In the absence of a force applied by an actuator, the only force applied to valve 110 is that of spring 134, which biases the fuel injector's valve 110 into a closed position.

When sufficient force is applied to valve 110 in the second direction by solenoid 130 (i.e., when the actuator force exceeds the spring force), valve 110 moves in the second direction (down) and opens. If the force applied by spring 134 varies linearly with displacement (as is the case with most springs over limited ranges of motion), then the displacement of valve 110 is typically proportional to the difference between the spring and actuator forces. Without the action of metering member 120, the fuel flow rate would typically vary approximately proportionally with the fuel inlet pressure, and at higher fuel pressure often depends only weakly on the actuator force. It is desirable in many instances to reduce or substantially eliminate such dependence of the fuel flow rate on the fuel inlet pressure. It is also desirable for the fuel flow rate to depend upon the actuating force (i.e., the net force exerted by solenoid 130 and spring 134 in the example of FIG. 1). Metering member 120 serves those functions, as further described below.

The restricted metering orifice 122 provides restricted fuel flow between primary fuel chamber 104 and secondary fuel chamber 116. As described above, when fuel injector 10 is closed, fuel pressure in those chambers is equalized and no additional pressure-induced force is exerted on valve 110. However, when fuel injector 10 is open and fuel is flowing, a pressure differential develops between primary fuel chamber 104 (higher pressure) and secondary fuel chamber 116 (lower pressure), due to the flow-dependent pressure drop through restricted metering orifice 122. That pressure differential results in a flow-dependent force that tends to urge valve 110 in the first (i.e., closing) direction. The result is a kind of negative feedback arrangement. Higher fuel inlet pressure leads to higher fuel flow, in turn resulting in an increase of the flow-dependent force tending to move valve 110 toward the closed position, thereby reducing the fuel flow. Conversely, a lower fuel inlet pressure leads to lower fuel flow, in turn resulting in a reduction of the flow-dependent closing force on valve 110, thereby increasing fuel flow.

Figure 2A:
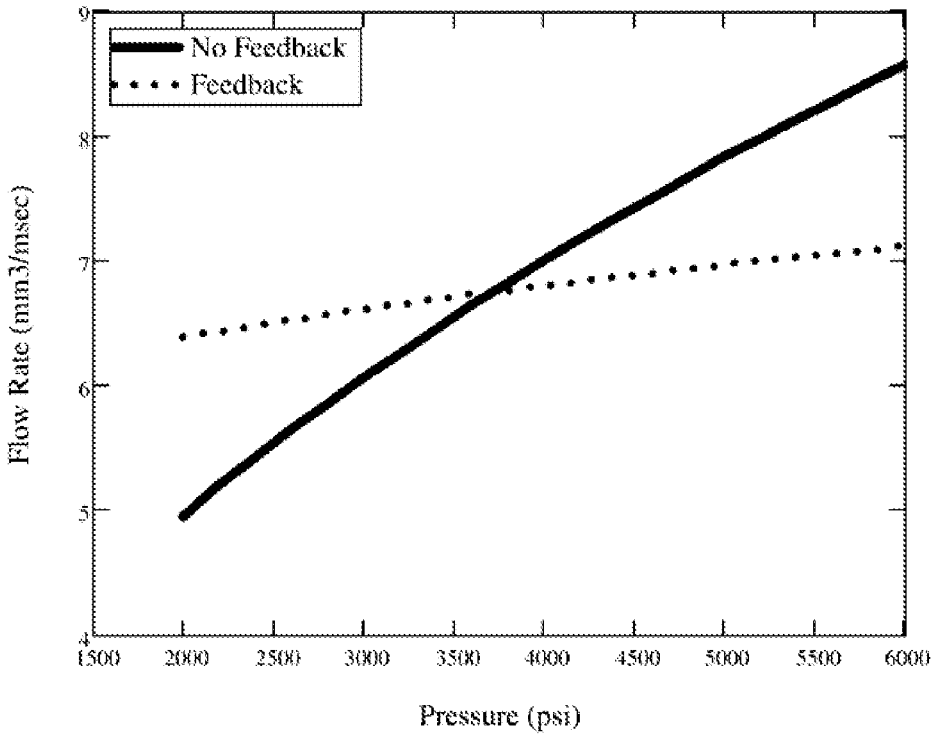
FIGS. 2A and 2B are calculated plots of fuel flow rate versus fuel inlet pressure for the exemplary fuel injector of FIG. 1.
Figure 2B:
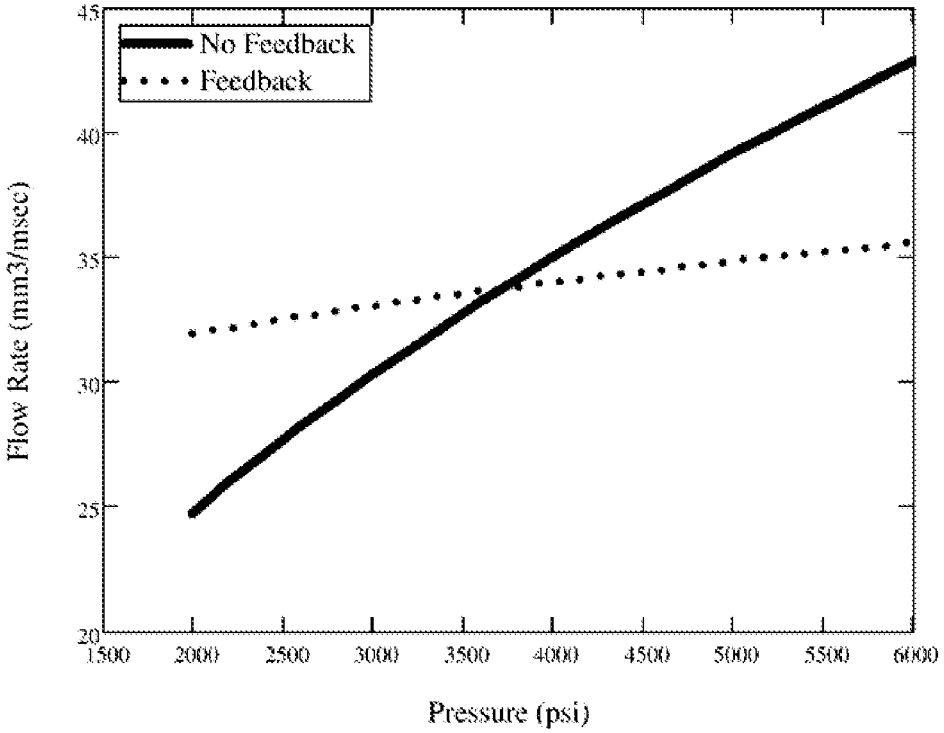

The negative feedback can reduce the dependence of the fuel flow rate through fuel injector 10 (for a given actuator force and spring force constant) on the fuel inlet pressure. For example, plots of calculated fuel flow rate versus fuel pressure for fuel injectors with negative feedback (dotted) and without negative feedback (solid) are shown in FIGS. 2A and 2B. The fuel flow rate through the fuel injector of FIG. 1 depends on the flow resistance of metering orifice 122 (metering flow area of 0.021 $mm^2$ for FIG. 2A and 0.105 $mm^2$ for FIG. 2B), the valve-position-dependent flow resistance at fuel outlet 110, the net non-flow-dependent force applied to valve 110 by spring 134 and the valve actuator (5 lbf for FIGS. 2A and 2B), and the areas of primary valve seal 108 and valve body 114 subject to the fuel pressures of each of the fuel chambers (pressure active area of 1.128 $mm^2$ for FIGS. 2A and 2B). The feedback can also reduce the effect on the fuel flow rate of injector temperature variations, which can be substantial in an internal combustion engine. The area of any outwardly extending flange on valve stem 112 decreases the influence of the negative feedback arrangement. Any set or subset of those parameters can be selected to yield a desired dependence of fuel flow on fuel inlet pressure.

In an exemplary embodiment, fuel injector 10 can include a spray-shaping surface or surfaces arranged to direct the fuel sprayed from the fuel outlet 101. The spray-shaping surface can be arranged on the injector body 102 around all or part of the valve seat 140, or the spray-shaping surface can be arranged around all or part of the valve-seat-engaging portion of the valve body 114.

In the exemplary embodiment of FIG. 3, a spray-shaping surface 142 is formed on injector body 102 just outside valve seat 140; two differing spray-shaping surfaces 142*a* and 142*b* are shown in FIG. 4. The indicated angle A in FIG. 3 (angles A1 and A2 in FIG. 4) between spray-shaping surface 142 (surfaces 142*a* and 142*b* in FIG. 4) and a lateral surface of valve body 114 can be selected to yield a desired geometry for the spray of fuel exiting fuel outlet 101 when injector 10 is open. Spray-shaping surface 142 can be rotationally symmetric, so that the cross-section of FIG. 3 would remain constant regardless of the rotation of fuel injector 10 about an axis defined by valve stem 112. The resulting fuel spray also would be rotationally symmetric about that axis. Alternatively, spray-shaping surfaces 142*a* and 142*b* can vary with angular position about its axis, resulting in a fuel spray that is not symmetric. Cross-sectional views of such an embodiment can resemble that of FIG. 4, with the angles A1 and A2 between surface 142 and valve body 114 varying depending on the rotational position of fuel injector 10 about its axis. A valve seat angle (angle S as shown in FIG. 3) can vary from 90° (i.e., a flat valve seat) down to any desired angle that does not cause the valve body to stick in the seat due to wedging. The angle of the valve seat 140 can also substantially affect the shape of the spray, e.g., if the seat angle S is less than the angle A.

Figure 6:
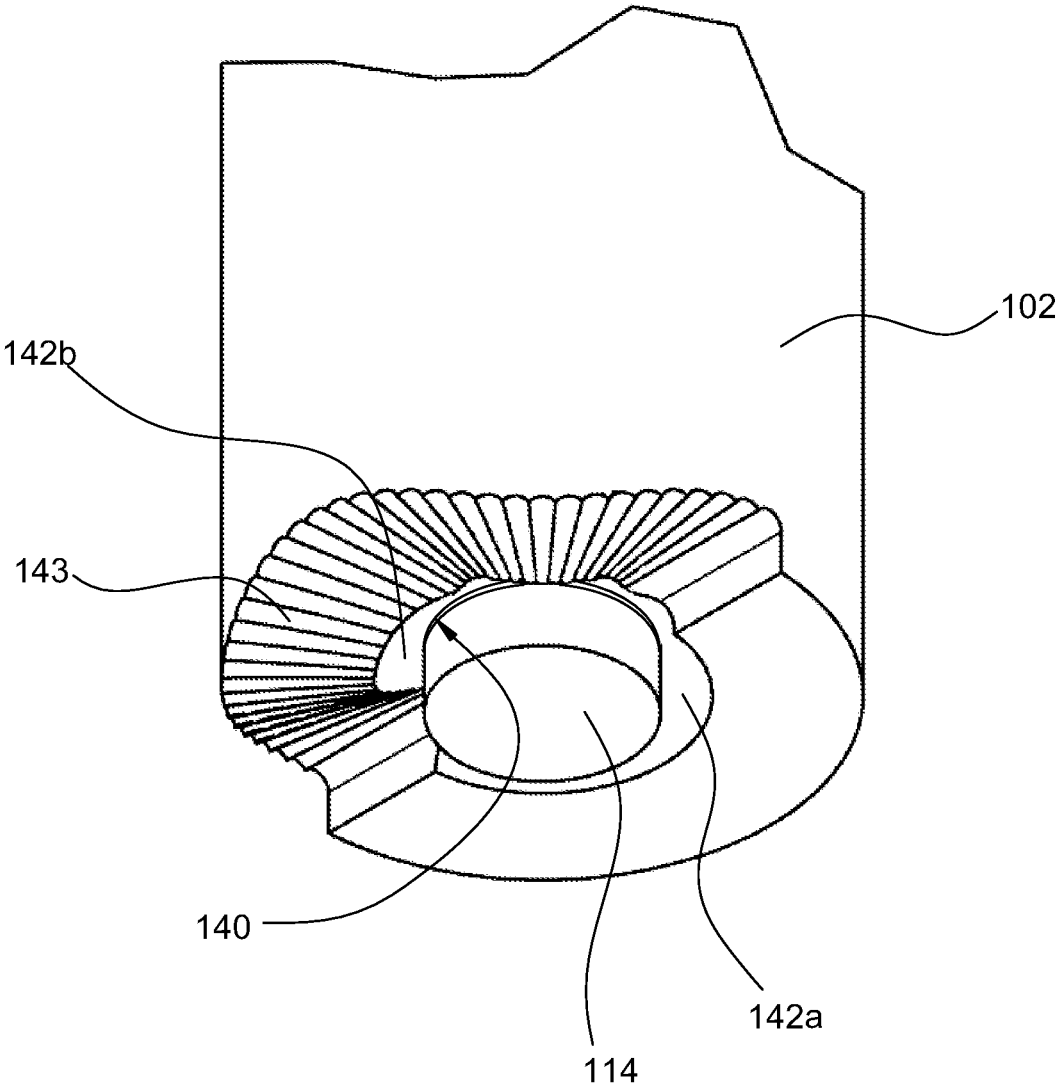
FIG. 6 is a perspective view of a fuel outlet and spray-shaping surface of an exemplary fuel injector.

One suitable shape for surface 142 can include a curved portion characterized by a radius and that begins tangent to the valve seat 140 and redirects the fuel spray toward the axis of the injector. A radius on the order of 0.01 inch can be employed, for example; any suitable radius can be employed as needed or desired. In addition, a single radius can be used, or the radius can vary circumferentially, radially, or axially, as needed of desired. The curved portion of the surface can be truncated at a point to yield the desired angle between the spray-shaping surface and the side of the valve body. If the curved portion of the surface is truncated at the same length around the entire circumference of the surface 142 (yielding angle A in FIG. 3), a rotationally symmetric spray pattern results. If the curved portion of the surface is truncated at differing lengths around the circumference of surfaces 142*a* and 142*b* (yielding angles A1 and A2 in FIG. 4), a rotationally asymmetric spray pattern can be created. An undulating, cam-like surface can be formed on the end of the fuel injector to truncate the curved surface at varying lengths (e.g., surface 143 shown in FIG. 6). In the example of FIG. 6, only a portion of the end of the fuel injector bears the cam-like surface 143, and those portions might resemble the cross section of FIG. 4. The remainder of the end of the injector, including surface 142*a*, might resemble the cross section of FIG. 3. Many differing cam-like shapes, combinations of differing cam-like shapes, or combinations of cam-like shapes and other shapes can be employed to produce a wide array of differing spray patterns. Any of those shapes can include additional surfaces features, e.g., radial grooves on the cam-like surface.

By employing a spray-shaping surface that varies around the circumference of the valve seat, a spray pattern results that is dispersed over a range of "elevation angles" (i.e., angles with respect to the injector axis). Such a "corrugated" spray pattern has been observed to provide a large surface area spray for mixing fuel and air, and exhibits a lesser tendency to collapse toward the injector axis than a wide-angle conical spray. A wide variety of shapes can be implemented to yield a correspondingly wide array of desired fuel spray shapes for fuel injector 10.

Angles A, A1, and A2 can vary from 0° (creating a spray directed substantially axially) to 90° (creating a spray directed substantially radially). In some instances and angle greater than 90° could be employed. In one example, valve seat 140 is arranged with a seat angle of about a 45°, a radius of a curved portion of surface 142 of about 0.005 inches, a diameter of about 0.062 inches for valve body 114, and an angle A of about 0°, yielding a spray directed generally axially and subtending a cone angle of about 10° (half-angle). In various different fuel injection arrangements in various internal combustion engine types, differing angular ranges may provide desirable spray shapes or improved fuel injection. For example, angle A (or A1 and A2) can be made larger than about 60° or smaller than about 85° for use in a directly injected, conventional compression-ignition engine (e.g., a piston diesel engine). In another example, angle A (or A1 and A2) can be made larger than about 5° or smaller than about 60° for use in a two-stroke gasoline engine. In another example, angle A (or A1 and A2) can be made larger than about 15° or smaller than about 45° for use in a gasoline, direct-injected engine. In another example, angle A (or A1 and A2) can be made larger than about 0° or smaller than about 25° for use in a pre-chamber-injected engine. Those angular ranges can be employed in any suitable engine type (including those not listed above), or other suitable angular ranges can be employed for any suitable engine type (including those listed above).

In the exemplary embodiment of FIG. 5, a spray-shaping surface 144 is formed on valve body 114 just outside the area where it engages valve seat 140. The indicated angle B between spray-shaping surface 144 and a substantially vertical lateral surface of valve body 114 can be selected to yield a desired geometry for the spray of fuel exiting fuel outlet 101 when injector 10 is open. Such an arrangement would be typically employed in an injector having a conical valve seat, and the angle B might typically vary between about 30° and 90°; other suitable angles can be employed. As described above, spray-shaping surface 144 can be rotationally symmetric, or it can vary with angular position about its axis (not shown). Simple or complex curved surfaces or grooved surfaces can be employed. More generally, spray-shaping surfaces can be formed in any desired configuration on either or both of injector body 102 or valve body 114. If a spray-shaping surface is formed on valve body 114, the force exerted on that surface by the fuel spray typically should be accounted for when implementing the negative feedback mechanism described above.

Figure 7:
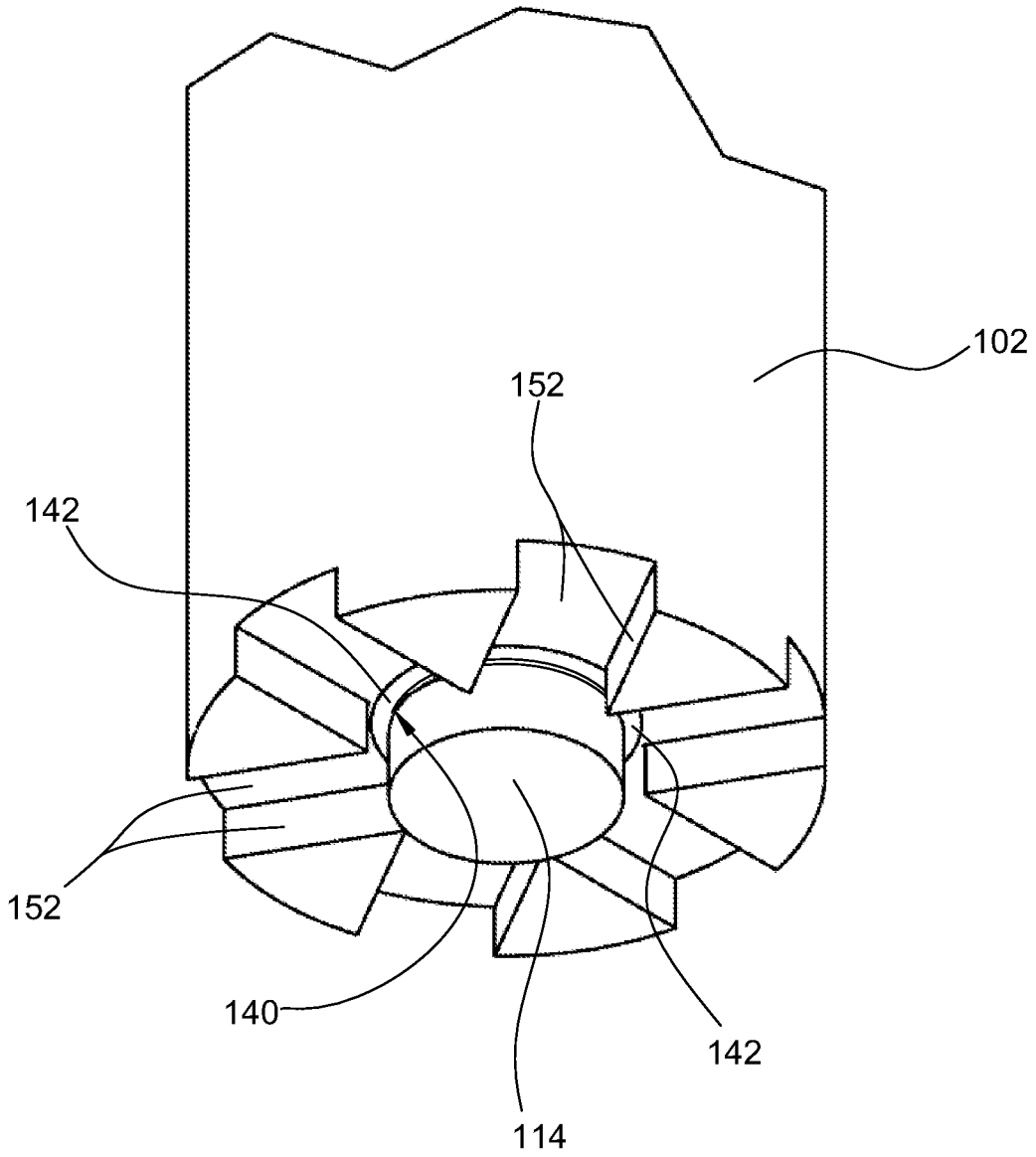
FIG. 7 is a perspective view of a fuel outlet and spray-shaping surface of an exemplary fuel injector.

In addition to spray-shaping surfaces 142 or 144 positioned near the valve seat 140, other spray-shaping surfaces or structures can be employed to shape or guide the fuel spray. In the exemplary embodiment of FIG. 7, spray-guiding surfaces 152 are arranged as a set of radially extending slots arranged around valve seat 140 and spray-shaping surface 142. Any suitable arrangement of such surfaces or structures for shaping or guiding the fuel spray shall fall within the scope of the term "spray-shaping" in the present disclosure or appended claims.

The arrangements and adaptation disclosed (i) for providing a desired dependence (or lack thereof) of fuel flow rate versus fuel inlet pressure or actuator force, or (ii) for providing a spray-shaping surface to yield a desired fuel spray pattern, can be implemented together in a single fuel injector. Alternatively, only one or the other of those arrangements or adaptations might be implemented in a given fuel injector.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

What is claimed is:

1. A fuel injector comprising:

(a) an injector body;

(b) a valve passage extending from a fuel inlet to a fuel outlet;

(c) a reciprocating valve extending through the valve passage;

(d) a valve seat;

(e) wherein the fuel injector is structured so that:

(i) movement of the valve in a first direction relative to the injector body causes engagement of the valve and the valve seat and substantially prevents fuel flow through the fuel outlet and movement of the valve in a second direction relative to the injector body, the second direction being opposite the first direction, displaces the valve from the valve seat and enables fuel flow through the fuel outlet; and (ii) with the valve engaged with the valve seat, the valve is substantially pressure balanced;

(f) a variably controllable electronic actuator coupled to the valve and exerting an actuating force on the valve in the second direction to create a displacement of the valve from the valve seat; and (g) a metering member separating the valve passage into a first fuel chamber and a second fuel chamber and arranged to permit only restricted fuel flow from the first fuel chamber into the second fuel chamber;

(h) wherein the fuel injector and the metering member are structured so that:

(i) with the valve displaced from the valve seat and fuel flowing through the fuel outlet, the restricted fuel flow through the metering member results in a fuel pressure differential between the first and second fuel chambers that in turn results in a flow-dependent force on the valve in the first direction, which force increases with increasing fuel flow through the fuel injector;

(ii) the flow-dependent force on the valve in the first direction substantially changes the displacement of the valve from that created by the actuating force in the second direction; and (iii) fuel flow rate through the fuel injector depends on the actuating force and substantially does not depend on fuel pressure at the fuel inlet.

2. The fuel injector of claim 1 further comprising a resilient spring member arranged to create a spring force on the valve in the first direction, and wherein the flow-dependent force on the valve in the first direction substantially changes the displacement of the valve from that created by the actuating force in the second direction net of the spring force in the first direction.

3. The fuel injector of claim 2 wherein the actuator comprises a solenoid, and wherein the actuating force, and hence the fuel flow rate, is controlled by a current of the solenoid.

4. The fuel injector of claim 1 wherein the pressure balancing is facilitated by a valve seal positioned and arranged to substantially prevent fuel flow along the valve from the first fuel chamber past the valve seal.

5. The fuel injector of claim 1 wherein the metering member comprises a circumferential flange that extends radially inward from the injector body.

6. The fuel injector of claim 1 wherein the metering member comprises a circumferential flange that extends radially outward from the valve.

7. The fuel injector of claim 1 wherein the metering member comprises a circumferential flange that engages the valve but contains a sized hole therethrough extending from the first fuel chamber to the second fuel chamber.

* * * * *